US006116011A

United States Patent [19]

Wassen et al.

[11] Patent Number: 6,116,011

[45] Date of Patent: Sep. 12, 2000

[54] IMPURITY-REMOVAL DEVICE FOR AN OPEN-END SPINNING MACHINE

[75] Inventors: Willi Wassen, Schwalmtal; Ralf Stewert; Lothar Uedinger, both of Mönchengladbach, all of Germany

[73] Assignee: W. Schalfhorst AG & Co., Monchengladbach, Germany

[21] Appl. No.: 09/237,302

[22] Filed: Jan. 26, 1999

[30] Foreign Application Priority Data

Feb. 10, 1998 [DE] Germany ..... 198 05 235
Jun. 20, 1998 [DE] Germany ..... 198 27 610

[51] Int. Cl.[7] ..... D01H 11/00

[52] U.S. Cl. ..... 57/301; 57/306; 57/406; 57/408

[58] Field of Search ..... 57/301, 306, 406, 57/408

[56] References Cited

U.S. PATENT DOCUMENTS

| | | | |
|---|---|---|---|
| 3,924,397 | 12/1975 | Stahlecker et al. | 57/301 |
| 4,162,556 | 7/1979 | Van Ditshuizen et al. | 57/301 |
| 4,183,201 | 1/1980 | Stahlecker | 57/306 |
| 5,901,543 | 5/1999 | Anthony | 57/301 |
| 5,943,853 | 8/1999 | Stahlecker | 57/301 |

FOREIGN PATENT DOCUMENTS

| | | |
|---|---|---|
| 23 54 967 A1 | 5/1975 | Germany . |
| 23 56 180 A1 | 6/1975 | Germany . |
| 26 34 770 A1 | 2/1978 | Germany . |
| 26 58 752 A1 | 7/1978 | Germany . |
| 196 40 546 A1 | 4/1998 | Germany . |

*Primary Examiner*—Willliam Stryjewski
*Attorney, Agent, or Firm*—Kennedy, Covington, Lobdell & Hickman, LLP

[57] ABSTRACT

An open-end spinning machine (1) with a plurality of adjacent open-end spinning units (2) each having a sliver opening device (4) with impurity-discharge openings (10). An impurity-removal device (11) is installed below the impurity-discharge openings (10) and comprises an impurity-removal belt (12) which can be driven in a reciprocating manner. A cleaning carriage (16) is arranged on the impurity-removal belt (12) and is connected by frictional engagement to the impurity-removal belt (12). The cleaning carriage (16) has a cleaning lip (18) which mechanically cleans the areas of the sliver opening devices (4) especially endangered by contamination. The cleaning carriage (12) can be shifted as required relative to the impurity-removal belt (12).

19 Claims, 7 Drawing Sheets

IMPURITY-REMOVAL DEVICE FOR AN OPEN-END SPINNING MACHINE

BACKGROUND OF THE INVENTION

The present invention relates to an open-end spinning machine with an impurity-removal device for removing dirt, soil, debris, plant matter and like impurities separated from fibers by sliver opening devices associated with the spinning stations of the machine.

Such impurity-removal devices are generally known in the state of the art, as described, e.g., in German Patent Publications DE Patent 23 56 180, DE-AS 26 34 770 or DE-OS 26 58 752.

German Patent Publication DE Patent 23 56 180 discloses rotor spinning units of an OE (i.e. open end) spinning machine with a conveyor belt arranged below the impurity-discharge opening of the open-end spinning units and traveling in the longitudinal direction of the machine, which conveyor belt receives and removes the impurities released during the opening of the sliver.

A potential problem with such impurity-removal devices is that tufts of fibers may form over the course of time in the area of the impurity-discharge openings by the settling of impurities and fibers. Such fiber tufts could be drawn back by suction into the area of the opening cylinder and possibly delivered therefrom into the spinning unit, which would then significantly disturb the spinning operation. In order to prevent such tufts of fibers from being able to form, a brush-like cleaning element is arranged on the conveyor belt the bristles of which cleaning element extend into the area of the impurity-discharge openings of the spinning units as the belt travels.

In the known spinning machines, the spinning units are arranged in two aligned rows essentially back to back along opposite sides of the machine. At the ends of the machine, the endless conveyor belt in the known impurity-removal device is deflected to reverse its course of travel and move along the opposite side of the machine, thereby for the removal of the impurities accumulating on the other side of the machine. The cleaning element is permanently arranged on the conveyor belt.

A similar impurity-removal device for open-end spinning machines is also described in German Patent Publication DE-OS 26 56 752. In this known device, a tangential belt is provided as a transport means for cleaning elements and serves at the same time as an impurity-removal means. This tangential belt, which is preferably a reciprocating belt, carries several differently designed cleaning elements arranged in series and collected into a group. The cleaning elements are fixed in a detachable and replaceable manner in holders which are permanently arranged on the tangential belt and are delivered during the travel of the tangential belt to the components of the spinning units which are endangered by impurities. That is, the cleaning elements can be removed as needed from the stationary tangential belt and replaced, if necessary, whereas during the travel of the tangential belt the cleaning elements are immovably fixed on the tangential belt.

Moreover, German Patent Publication DE-AS 26 34 770 describes an impurity-removal device for open-end spinning machines in which device an impurity-removal belt is arranged below the impurity-discharge openings of the sliver opening devices. The impurity-removal belt is arranged along the upper side of an air conduit comprising a through slot. The impurity-removal belt has an opening which provides communication between the air conduit and the impurity-discharge openings of the individual sliver opening devices. In addition, an impurity wiper is arranged in the area of this opening via a holder.

During the course of the spinning process both coarse impurity components as well as fine impurity particles and fiber fluff are removed through the impurity-separation openings. The coarse impurity components as well as a portion of the fine impurity particles and the fiber fluff are discharged directly onto the impurity removal belt to be removed immediately as it moves along the air conduit. However, some of the remaining fine impurity particles and the fiber fluff settle at first in the area of the impurity-discharge openings of the sliver opening devices and are removed from there by the wiper.

The wiper is permanently arranged on the impurity-removal belt in the area of aforesaid the impurity-discharge openings and is moved with the conveyor belt along the air conduit. Thus, the wiper passes simultaneously with the opening into the area of a spinning location, where it mechanically separates the fine impurity components and the fluff from the guide walls of the sliver opening device. The separated impurity particles are then removed by suction through the opening into the air conduit.

As is the case in the other known impurity-removal devices, in German Patent Publication DE-AS 26 34 770 the wiper is also permanently arranged on the impurity conveyor belt. That is, the wiper is constantly moved back and forth between reversing points in the area of the end frames of the machine by the conveyor belt driven in a reciprocating manner. The reversal of the direction of motion of the conveyor belt takes place via switching elements which are arranged in the area of the end frames of the machine and are actuated by the holder of the wiping element.

SUMMARY OF THE INVENTION

In view of the above-discussed state of the art, it is an object of the present invention to provide an improved impurity-removal device for open-end spinning machines.

The present invention achieves this objective in an open-end spinning machine basically comprising a plurality of adjacent open-end spinning units each having a sliver opening device with an impurity-discharge opening, by providing an impurity-removal device arranged below the impurity-discharge openings which has an impurity transport belt driven in a reciprocating manner and a cleaning carriage with a wiper device resting on the impurity transport belt by frictional engagement for selective removal from the impurity transport belt.

This basic design of the impurity-removal device in accordance with the present invention has the advantage, among other things, that the frictional resting support of the cleaning carriage on the impurity-removal belt is essentially unaffected by blockages or jams and specifically assures that even if the travel path of the cleaning carriage with the belt is blocked, e.g., by an open cover of an open-end spinning unit, the regular removal of impurities is not adversely affected nor is there any danger of damage to the cleaning carriage or to the spinning unit.

This frictional blockage-resistant fixation of the cleaning carriage makes it possible to reciprocate the impurity-removal belt in set time intervals without having to consider any carriage. Any additional sensors for detecting the position of the cleaning carriage are not necessary. The cleaning carriage moves automatically at the end of each passage against a stop arranged in the area of the end frame of the machine and remains there until the change of the direction of transport of the impurity-removal belt. In this manner a synchronous running of the cleaning carriages is always automatically adjusted at each change of the direction of transport.

An advantageous embodiment of the invention provides that the cleaning carriage rests freely on the impurity-removal belt by a stable support foot. An elastic cleaning lip is fixed to the support foot and extends therefrom into the area of the components of the OE spinning units subject to contamination. On the one hand, a cleaning carriage designed in this manner can be manufactured quite economically and on the other hand such a cleaning carriage assures that all components subject to contamination are reliably cleaned during the normal ongoing operation of spinning. In particular, the support foot preferably has a T-shaped design which represents a very stable, sturdy and simple design.

In order to assure a reliable removal of impurities even in the case of a blockage of the cleaning carriage on the impurity-removal belt, the support foot of the cleaning carriage comprises a portal-like passage opening. The impurities being transported by the belt can thus still be transported and removed through this portal-like passage opening even if the cleaning carriage is blocked, e.g., by a folded-out swiveling cover, as has already been indicated above.

In addition, an advantageous embodiment provides that the cleaning lip is adapted with its outer contour to the form of the components of the sliver opening devices which components are to be cleaned. The cleaning lip thus preferably comprises several differently formed cleaning fingers. The individual cleaning fingers can differ from each other as regards their length, their shape or even their material, in accordance with the design of the sliver opening devices to be cleaned. That is, an appropriate shaping of the cleaning fingers makes possible in an economical manner a reliable cleaning of the critical areas of the open-end spinning units.

Moreover, a further development of the invention provides that a starting device is arranged in the area of each of the impurity-removal belts which starting device makes it possible in a simple manner to lift the cleaning carriage out of frictional resting engagement on the impurity-removal belt. On the one hand, the use of such a starting device can clearly reduce the wear both on the impurity-removal belt and on the cleaning carriage since the cleaning carriage is lifted off of the impurity-removal belt when it is not needed. On the other hand, the cleaning carriage is held in a in an inactive "parked" position by the starting device ready to be used at any time if the degree of contamination of the open-end spinning units of the machine side concerned requires it.

In a preferred embodiment the starting device is mounted in an end area of the impurity-removal belt, preferably at the end opposite a cleaning- and suction-removal device of the impurity-removal belt. The spatial conditions in this area of the machine make possible both a relatively simple and uncomplicated installation of a starting device as well as a parking of the cleaning carriage lifted off from the impurity-removal belt without any adverse effects or hindering of the spinning process of the open-end spinning machine occurring.

The starting device preferably comprises a vertically movable receiving element for the cleaning carriage which element has a receiving means extending approximately parallel to the impurity-removal belt and configured to extend under the cleaning carriage in the area of its passage opening. The starting device can thereby move the receiving element between an active receiving or transferring position adjacent the belt for picking up therefrom or setting down thereon the cleaning carriage and the inactive parked position raised away from the impurity-removal belt by means of a thrust-piston transmission unit which can be loaded in a defined manner.

Further details, features and advantages of the present invention will be described and understood from the following disclosure of a preferred embodiment in conjunction with the accompanying drawings.

DESCRIPTION OF THE PREFERRED EMBODIMENT

Figure 1:
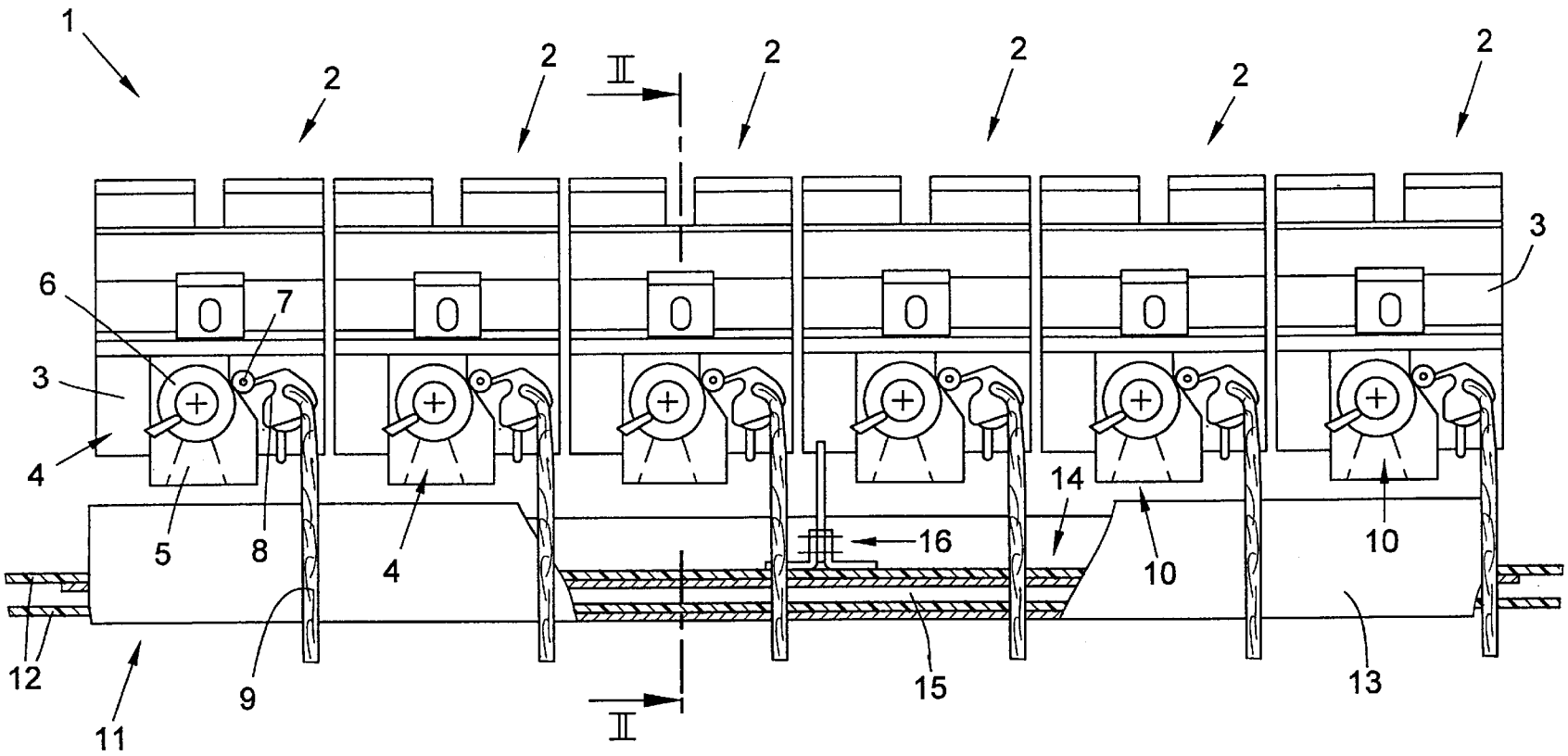
FIG. 1 is a front elevational view of several serially arranged open-end spinning units of an OE rotor spinning machine with an impurity-removal device in accordance with the present invention arranged below the sliver opening devices of the spinning units.

Referring now to the accompanying drawings and initially to FIG. 1, several serially aligned open-end spinning units 2 of an open-end rotor spinning machine 1 are shown in front elevational view. As is known, in modem OE rotor spinning machines, often far more than one hundred of these open-end spinning units are arranged in alignment with each other along each side of the spinning machine.

These open-end spinning units 2, which are known and described, e.g., in German Patent Publication DE 195 24 837 A1, comprise a suction-loaded rotor housing 21 in which a spinning rotor 22 rotates at a high speed. The rotor housing, which is not shown in FIG. 1, is open to the front and is closed during spinning operation by a swiveling cover element 3. Swiveling cover 3 also comprises, among other things, a sliver opening device 4.

Sliver opening device 4 operates to separate a sliver 9 being fed to the spinning unit into spinnable individual fibers. For such purpose, the sliver opening device 4 comprises, as is customary, an opening cylinder 6 rotating in an opening-cylinder housing 5, a delivery roller 7 and a sliver feed trough with a sliver compressor 8 facing to the front of the machine. The opening-cylinder housings 5 of these sliver opening devices also have impurity-discharge opening 10 for removal of impurities which are liberated during the opening of sliver.

Figure 2:
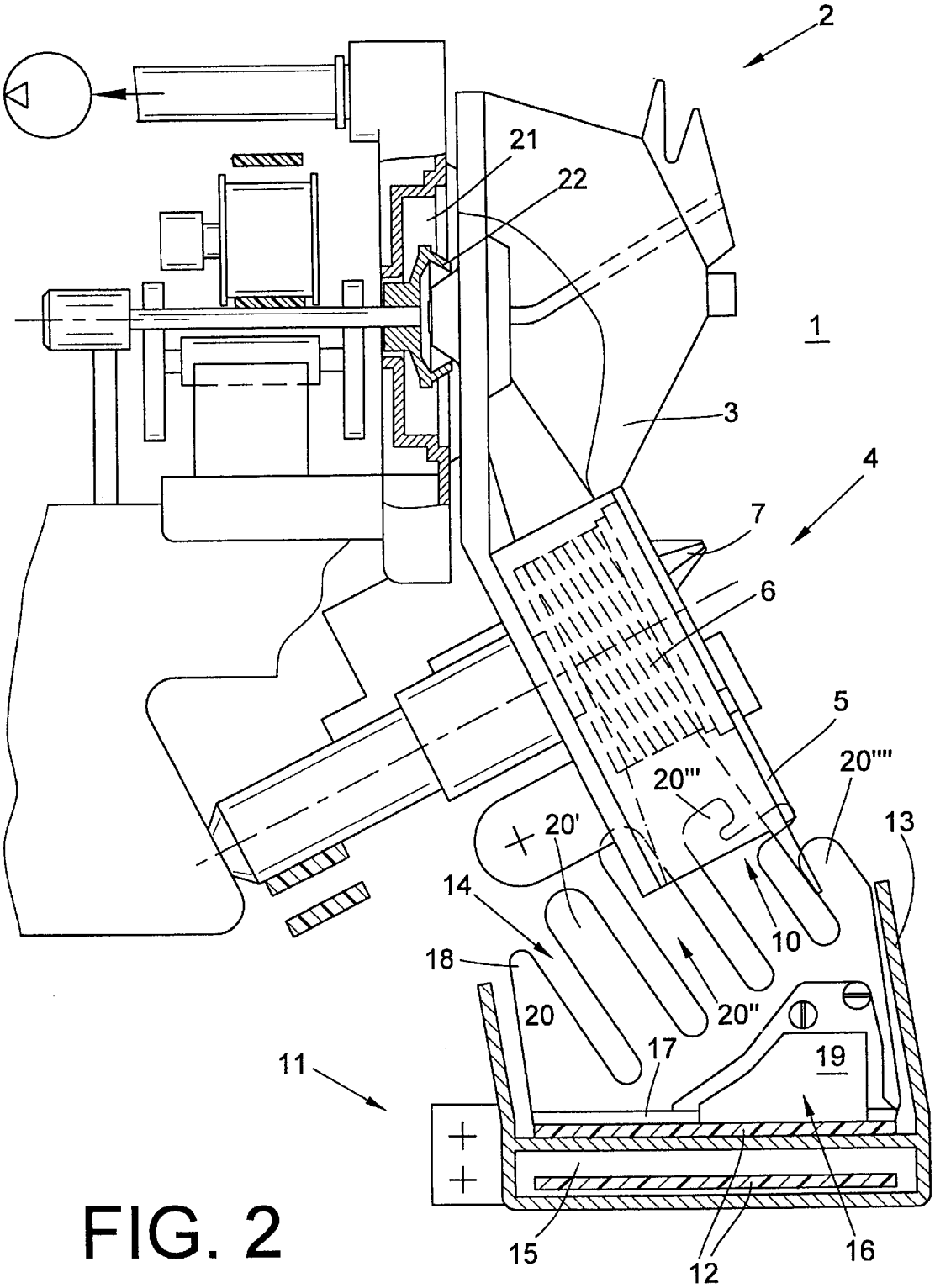
FIG. 2 is a side elevational view of one of the open-end spinning units of the machine of FIG. 1, taken along section line II—II in FIG. 1.

As is also apparent from FIG. 2, the spinning machine includes a mechanical impurity-removal device 11 comprising an endless impurity-removal belt 12 guided in a conduit assembly 13 extending along the length of the machine below the impurity-discharge openings 10. The conduit assembly 13 comprises, as is customary, an upwardly-open impurity-removal conduit 14 and a return conduit 15 located thereunder within which the endless impurity-removal belt 12 is driven via an electric motor (not shown).

A cleaning carriage 16 rests frictionally on the upper run of the endless impurity-removal belt 12 extending in the impurity-removal conduit 14 and is entrained by such frictional engagement to travel with the impurity-removal belt 12 during the operation thereof.

Figure 3:
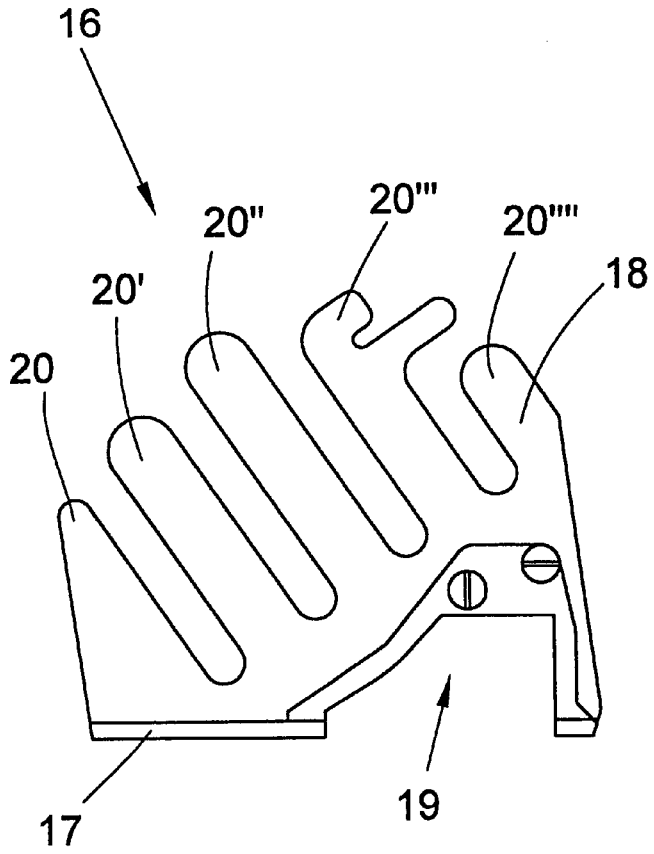
FIG. 3 is a side elevational view of a cleaning carriage in accordance with the present invention.
Figure 4:
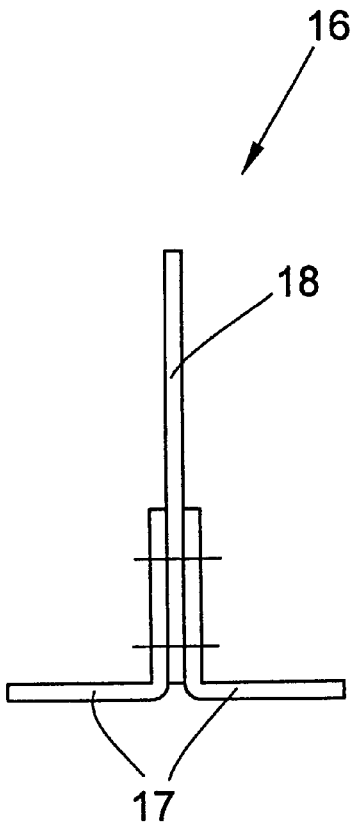
FIG. 4 is an end elevational view of the cleaning carriage of FIG. 3 as viewed from the front elevational view of FIG. 1.

The cleaning carriage 16 of the present invention is shown in FIGS. 3, 4 on a larger scale and is comprised preferably of two-components, e.g., a lower metallic support foot 17 for resting on the upper belt surface and an elastic cleaning lip 18 upstanding from the support foot 17 to extend into the area of the impurity-discharge openings 10 of the sliver opening devices 4. Moreover, the support foot 17 comprises a portal-like passage opening 19 which enables the transport and removal of impurities to continue along the impurity-removal belt 12 even if frictional transport of the cleaning carriage 14 with the traveling belt 12 should be temporarily blocked, e.g., by engagement with an outwardly opened swiveling cover of an open-end spinning unit.

The cleaning lip 18 comprises a plurality of cleaning fingers 20, 20', 20", etc., which can differ from each other both as regards their size, shape and/or their material. That is, cleaning fingers 20, 20', 20", etc., are preferably specially adapted to the contours of the components of the sliver opening devices 4 which are subject to contamination. Cleaning fingers 20, 20', 20", etc., wipe during operation along such areas of the open-end spinning units subject to contamination and mechanically loosen any accumulated particles of impurities. The loosened particles of impurities fall onto the impurity-removal belt 12 and are transported by the latter to pneumatic devices for the removal of impurities by suction (not shown) located in the area of the end frames of the machine.

On the whole, the provision by the present invention of the cleaning carriage 16 frictionally supported on and transported by the impurity-removal belt 12 and of the cleaning lip 18 wiping along the areas of sliver opening device 4 which are especially endangered by contamination, achieves a clearly improved removal of impurities, which has a positive effect on the operation of the spinning machine, not the least of which is a reduction of the yarn breaks which occur.

Figure 5:
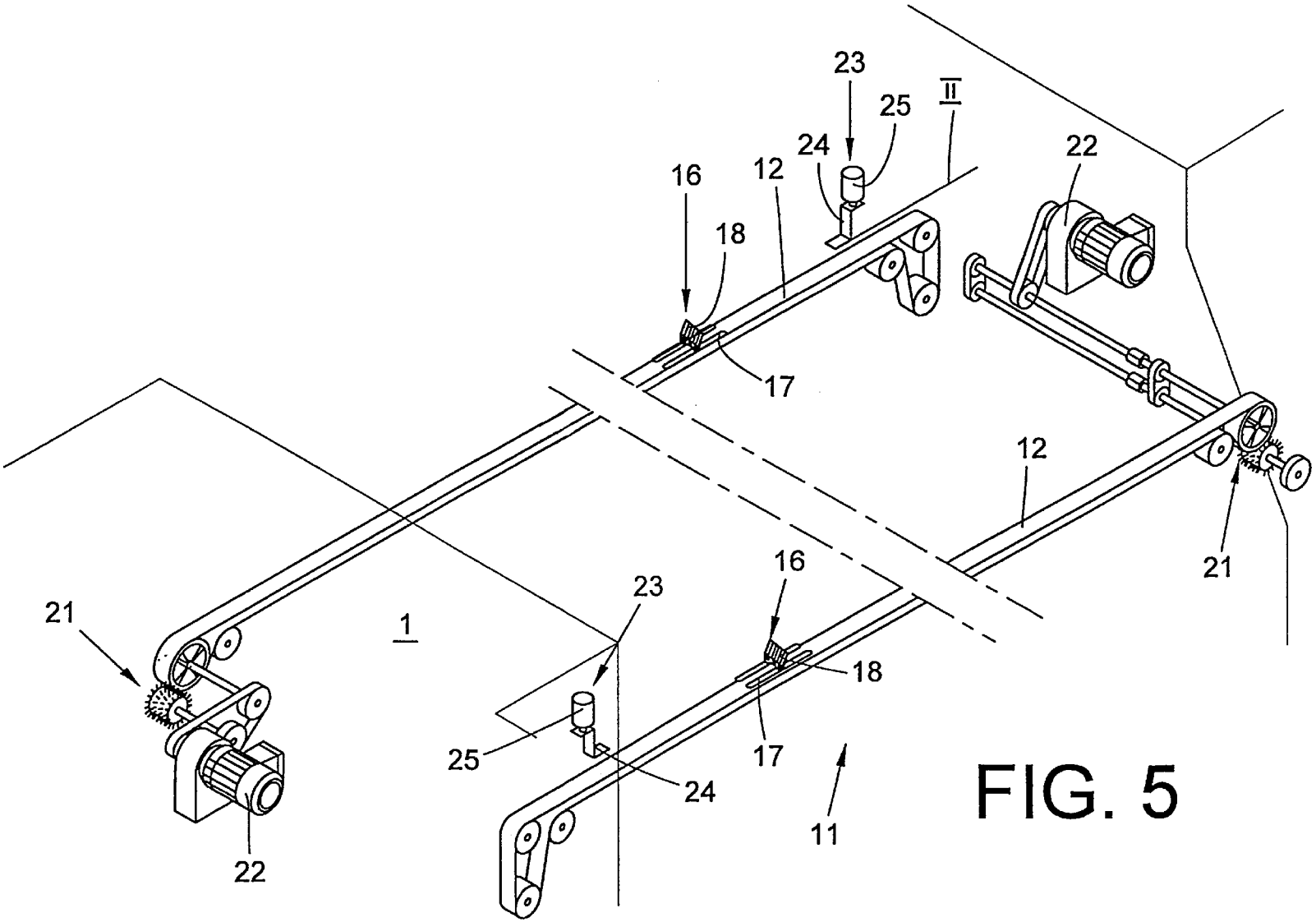
FIG. 5 is a schematic perspective view of the impurity-removal device of the open-end spinning machine of FIG. 1 showing the starting devices arranged adjacent the impurity-transport belt for lifting the cleaning carriage off of the impurity-removal belts.
Figure 5A:
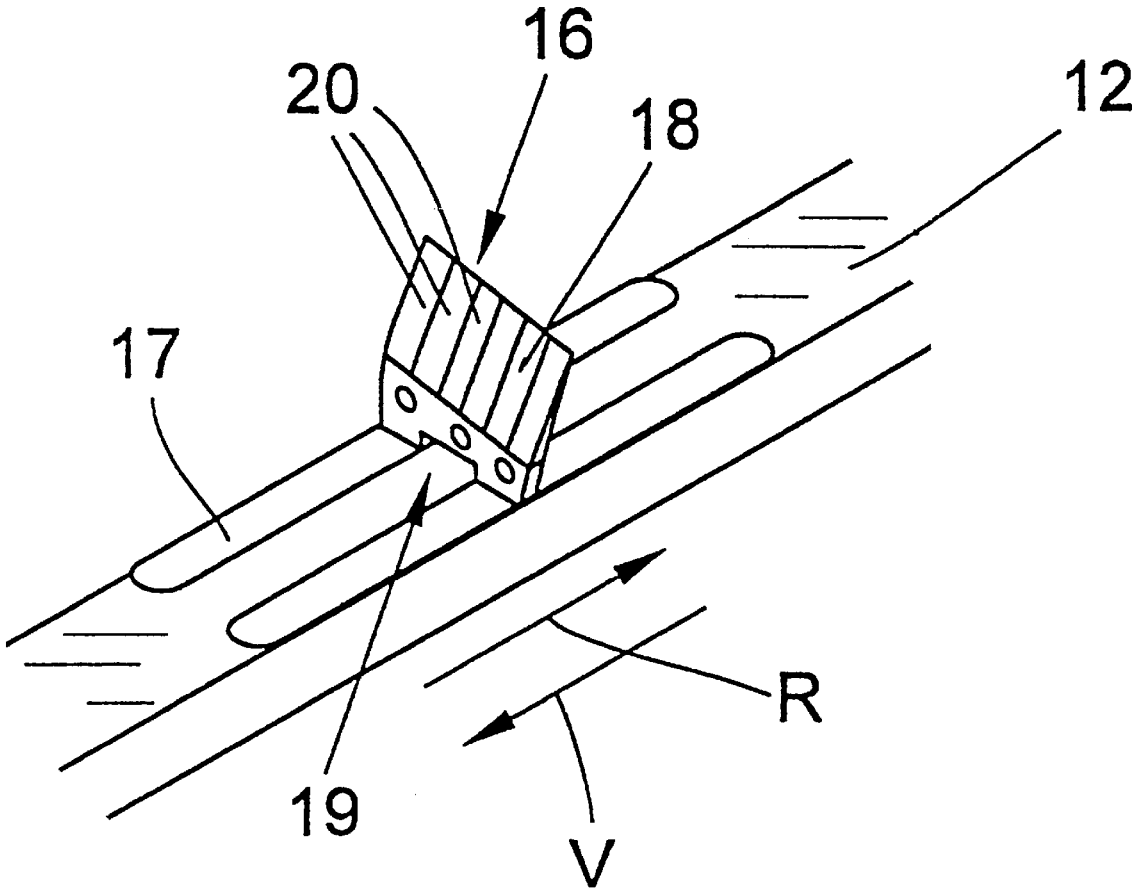
FIG. 5A is a enlarged view of a cleaning carriage of FIG. 5.
Figure 6:
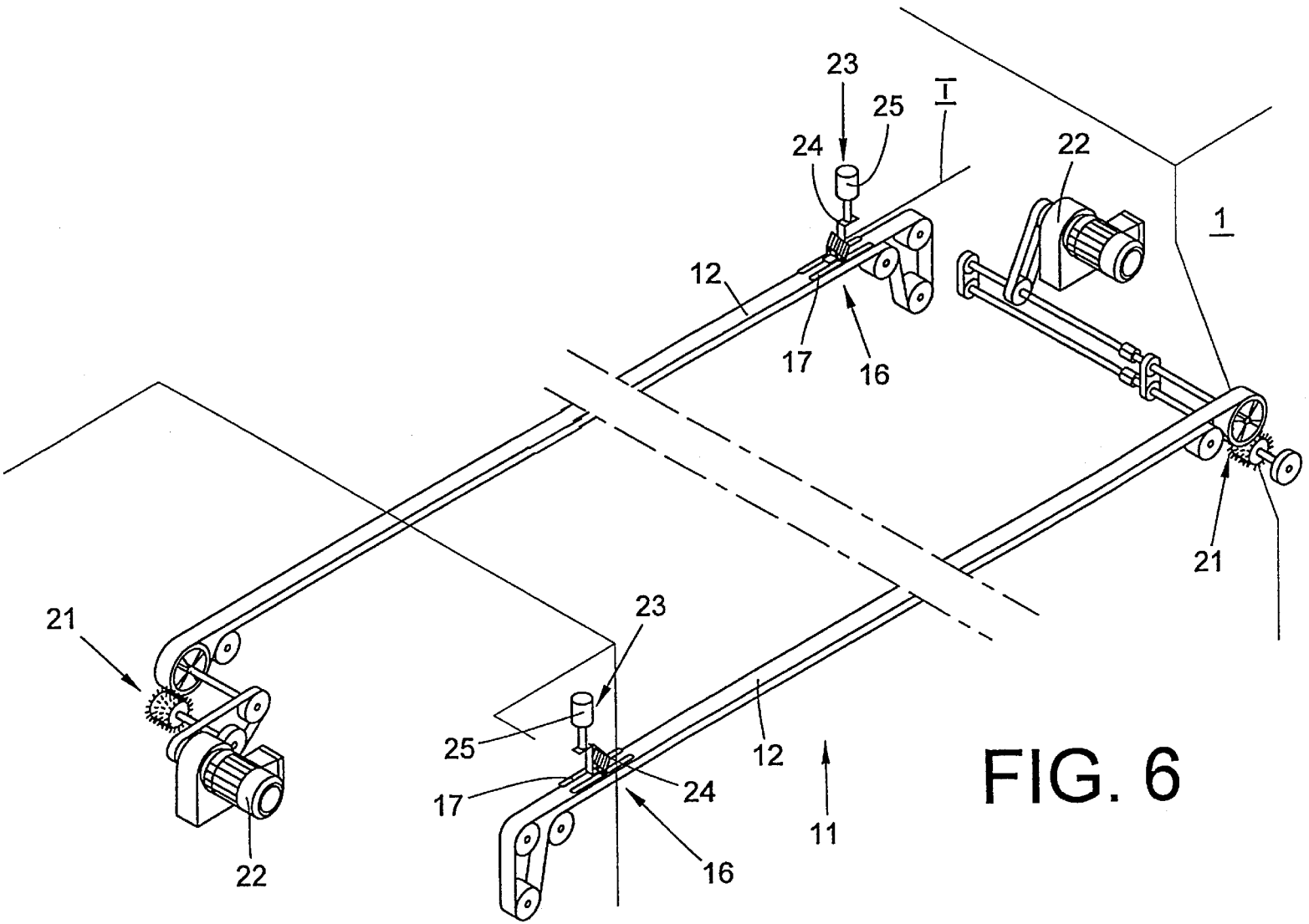
FIG. 6 is another schematic perspective view of the impurity-removal device from the same perspective as FIG. 5 depicting the cleaning carriages in the process of being received by the starting devices.
Figure 6A:
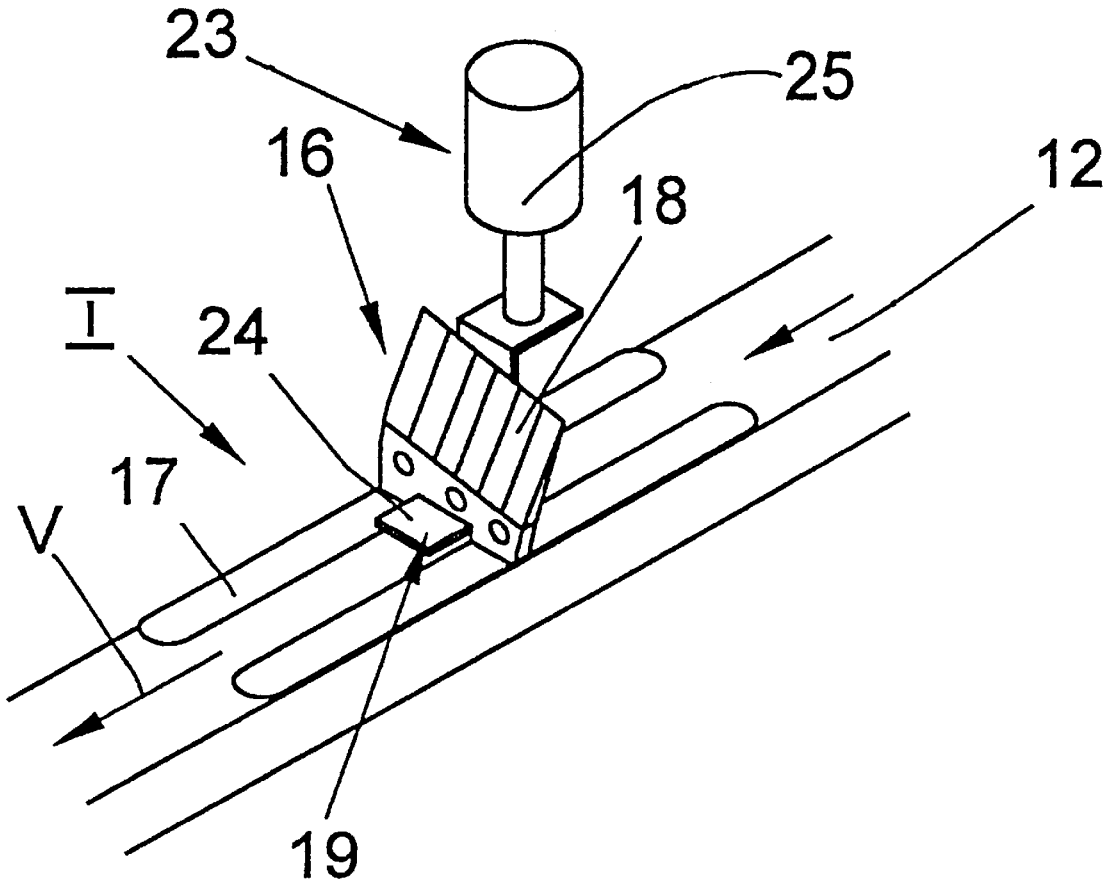
FIG. 6A is a enlarged view of a cleaning carriage and starting device of FIG. 6.

FIGS. 5 and 6 schematically show a perspective view of the mechanical impurity-removal device 11 of the open-end spinning machine 1.

As shown, the spinning machine has an endless impurity-removal belt 12 extending along each longitudinal side of the machine below the aligned open-end spinning units of the respective machine sides (not shown in FIGS. 5,6). Impurity-removal belts 12 are driven via reversible electric motors 22 and can travel in either forward direction V or reverse direction R. A cleaning carriage 16 as above-described is arranged to rest on each of impurity-removal belts 12 and is entrained by the rotating impurity-removal belt via frictional engagement. Each of the impurity-removal belts 12 has a cleaning and suction removal device 21 at one end in the area of its respective drive 22 and has a starting device 23 adjacent the opposite belt end.

As is indicated in FIGS. 5 and 6, these starting devices 23 comprise a receiving element 24 for the cleaning carriage and a thrust-piston transmission unit 25 which can extend and retract the receiving element 24 toward and away from the impurity-removal belt 12 between an active position I (FIG. 6) lowered closely adjacent the belt 12 for receiving (i.e. picking up) the cleaning carriage 16 from the belt 12 and transferring (i.e. returning) the cleaning carriage 16 to the belt 12 and an inactive position II raised from the belt 12. In the active receiving and transferring position I, a horizontal shank of the receiving element 24 for the cleaning carriage is positioned closely above the impurity-removal belt 12. Cleaning carriage 16 traveling with the impurity-removal belt 12 in direction R moves with its passage opening 19 over this horizontal shank whereupon the carriage 16 can be subsequently raised by its foot 17 into the inactive position II by the thrust-piston transmission unit 25.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning machine comprising:

(a) a plurality of adjacent open-end spinning units each having a sliver opening device with an impurity-discharge opening, and (b) an impurity-removal device arranged below the impurity-discharge openings and having, (i) an impurity transport belt driven in a first direction along a travel path adjacent the impurity-discharge openings, and (ii) a cleaning carriage disposed on the impurity transport belt for slidable movement of the transport belt relative to the cleaning carriage in the first direction, the cleaning carriage defining an opening extending in the first direction for the passage therethrough of impurities when the transport belt slides in the first direction relative to the cleaning carriage.

2. The open-ended spinning machine according to claim 1, wherein the cleaning carriage comprises a foot resting on the impurity transport belt and an elastic cleaning lip fixed to the support foot.

3. The open-end spinning machine according to claim 2, wherein the support foot is T-shaped.

4. The open-ended spinning machine according to claim 3, wherein the support foot extends in the direction of the travel path.

5. The open-end spinning machine according to claim 2, wherein the cleaning lip comprises a plurality of cleaning fingers differing from each other.

6. The open-end spinning machine according to claim 1, wherein the impurity-removal device comprises at least one starting device arranged in the area of the impurity-removal belt for lifting the cleaning carriage off the impurity-removal belt.

7. The open-end spinning machine according to claim 6, wherein the starting device is arranged at an end of the impurity-removal belt.

8. The open-end spinning machine according to claim 7, wherein a cleaning and suction-removal device is arranged at an end of the impurity-removal belt opposite the starting device.

9. The open-end spinning machine according to claim 6, wherein the starting device comprises a vertically movable element for receiving the cleaning carriage.

10. The open-end spinning machine according to claim 9, wherein the receiving element is configured to engage within a passage opening of the cleaning carriage.

11. The open-end spinning machine according to claim 9, wherein the starting device comprises a thrust-piston transmission unit for moving the receiving element between an active position for receiving the cleaning carriage and an inactive position.

12. The open-ended spinning machine according to claim 1, wherein the impurity transport belt is driven in a reciprocating manner.

13. The open-ended spinning machine according to claim 1, wherein a first generally planar bottom surface of the cleaning carriage rests directly upon a second generally planar top surface of the impurity transport belt, and wherein the cleaning carriage is transported along the travel path by the driven movement of the impurity transport belt only through surface friction existing between the first and second planar surfaces.

14. An open-end spinning machine comprising:

(a) a plurality of adjacent open-end spinning units each having a sliver opening device with an impurity-discharge opening; and (b) an impurity-removal device arranged below the impurity-discharge openings and having, (i) an impurity transport belt driven in a reciprocating manner, and (ii) a cleaning carriage resting on the impurity transport belt by frictional engagement for selective removal from the impurity transport belt;

(c) wherein the impurity-removal device comprises at least one starting device arranged in the area of the impurity transport belt for lifting the cleaning carriage off the impurity transport belt.

15. The open-end spinning machine of claim 14, wherein the starting device is arranged at an end of the impurity transport belt.

16. The open-end spinning machine of claim 15, wherein a cleaning and suction-removal device is arranged at an end of the impurity transport belt opposite the starting device.

17. The open-end spinning machine of claim 14, wherein the starting device comprises a vertically movable element for receiving the cleaning carriage.

18. The open-end spinning machine of claim 17, wherein the receiving element is configured to engaged within a passage opening of the cleaning carriage.

19. The open-end spinning machine of claim 17, wherein the starting device comprises a thrust-piston transmission unit for moving the receiving element between an active position for receiving the cleaning carriage and an inactive position.

* * * * *